US005117263A

United States Patent [19]

Adam et al.

[11] Patent Number: 5,117,263

[45] Date of Patent: May 26, 1992

[54] LIQUID TONER DEVELOPER

[75] Inventors: Yossi Adam, Rehovot; Alon Gazit, Givataim, both of Israel

[73] Assignee: Spectrum Sciences B.V., Wassenaar, Netherlands

[21] Appl. No.: 643,483

[22] Filed: Jan. 22, 1991

[51] Int. Cl.[5] ..... G03G 15/10

[52] U.S. Cl. ..... 355/256; 118/659; 137/594; 239/696

[58] Field of Search ..... 355/215, 245, 256, 326, 355/327; 118/659; 137/594, 595; 239/692, 693, 696

[56] References Cited

U.S. PATENT DOCUMENTS

| | | | |
|---|---|---|---|
| 4,800,839 | 1/1989 | Ariyama et al. | 355/327 X |
| 4,827,309 | 5/1989 | Kato | 355/256 |
| 4,870,446 | 9/1989 | Bickerstaff et al. | 355/282 |
| 4,994,860 | 2/1991 | Lunde et al. | 355/256 |

FOREIGN PATENT DOCUMENTS

WO90/14619 11/1990 World Int. Prop. O. .

*Primary Examiner*—A. T. Grimley
*Assistant Examiner*—Sandra L. Brasé
*Attorney, Agent, or Firm*—Sandler, Greenblum & Bernstein

[57] ABSTRACT

Imaging apparatus including an electrostatic imaging surface, latent image forming apparatus for forming an electrostatic latent image on said electrostatic imaging surface and development apparatus for developing said electrostatic latent image which includes supply apparatus for supplying a liquid toner to the image forming surface, the supply apparatus including a multiplicity of independently controllable outlets, preferably spray outlets, and a development surface for developing the electrostatic latent image using the liquid toner. The supply apparatus is preferably a multi-color supply apparatus and the multiplicity of outlets includes a plurality of individually controllable outlets, for supplying liquid toner of each of a plurality of colors.

13 Claims, 5 Drawing Sheets

LIQUID TONER DEVELOPER

FIELD OF THE INVENTION

The present invention relates generally to color electrostatic imaging and particularly to apparatus for developing color electrostatic images.

BACKGROUND OF THE INVENTION

Systems for color liquid toner electrostatic image reproduction are known in the art. These systems comprise apparatus for creating a latent electrostatic image on a surface through the formation of image and background areas, apparatus for developing the latent image including contacting the latent image with a liquid toner and a background cleanup apparatus that minimizes the undesirable deposition of toner on background surfaces. The development systems described in PCT patent application WO 90/14619 employ a reverse roller as a development surface with the reverse roller voltage intermediate the voltages on the image and background regions of the latent image bearing surface. Further, these systems include spray apparatus for supplying toner to the development rollers which spray apparatus includes a plurality of spray outlets connected to a common manifold.

SUMMARY OF THE INVENTION

There is provided in accordance with the present invention imaging apparatus having an electrostatic imaging surface, latent image forming apparatus for forming a electrostatic latent image on said electrostatic imaging surface, and development apparatus for developing the electrostatic latent image including supply apparatus for supplying a liquid toner to the image forming surface, the supply apparatus having a multiplicity of independently controllable outlets, preferably spray outlets and a development surface for developing the electrostatic latent image using the liquid toner. Preferably the apparatus is a multi-color supply apparatus and the multiplicity of outlets includes a plurality of individually controllable outlets, for supplying liquid toner of each of a plurality of colors.

There is further provided imaging apparatus having an electrostatic imaging surface, latent image forming apparatus for forming an electrostatic latent image on the electrostatic imaging surface and development apparatus for developing the electrostatic latent image including supply apparatus for supplying a liquid toner to the image forming surface, the supply apparatus including a multiplicity of outlets, preferably spay outlets, for supplying the liquid toner, at least one manifold for supplying liquid toner to the multiplicity of outlets and apparatus for preventing flow from the outlets to the manifold. Preferably, the supply apparatus is a multicolor supply apparatus and the multiplicity of outlets includes a plurality of individually controllable outlets, for supplying liquid toner of each of a plurality of colors and the at least one manifold includes separate manifolds for each the color.

In a preferred embodiment of the invention the apparatus for preventing includes at least one one-way valve which allows for toner flow only from the manifold to the outlets.

In a preferred embodiment of the invention the multiplicity of spray outlets form a single row. Preferably the single row of spray outlets comprises a linear array of interdigitated spray outlets for liquid toner of different colors.

In a preferred embodiment of the invention the system also includes a filter to remove paper fibers, fused toner, etc., from the toner to avoid clogging the valves.

BRIEF DESCRIPTION OF THE DRAWINGS

The present invention will be more fully understood and appreciated from the following detailed description, taken in conjunction with the drawings in which.

DETAILED DESCRIPTION OF PREFERRED EMBODIMENTS

Figure 1:
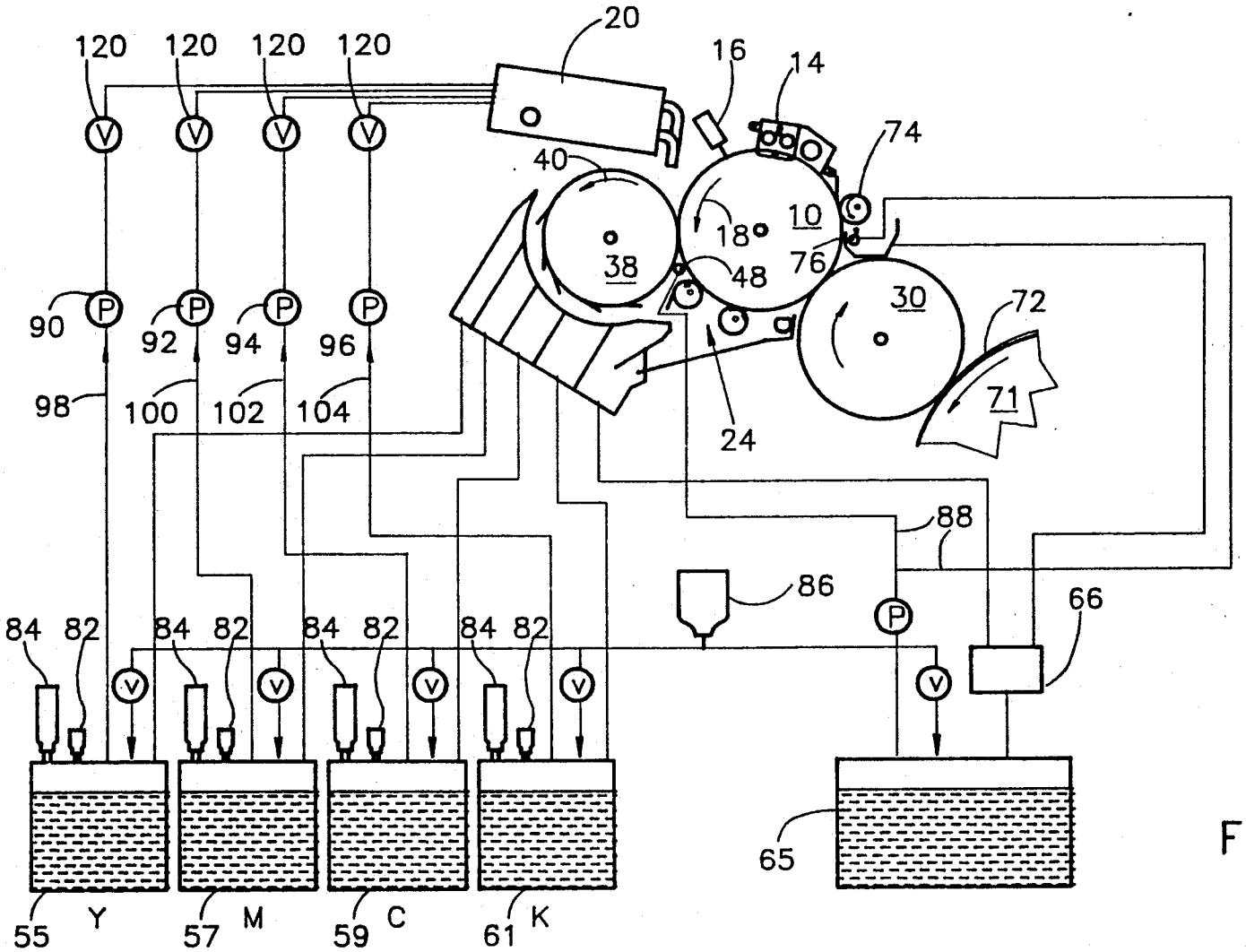
FIG. 1 is a generalized schematic illustration of an imaging system constructed and operative in accordance with a preferred embodiment of the present invention.
Figure 2:
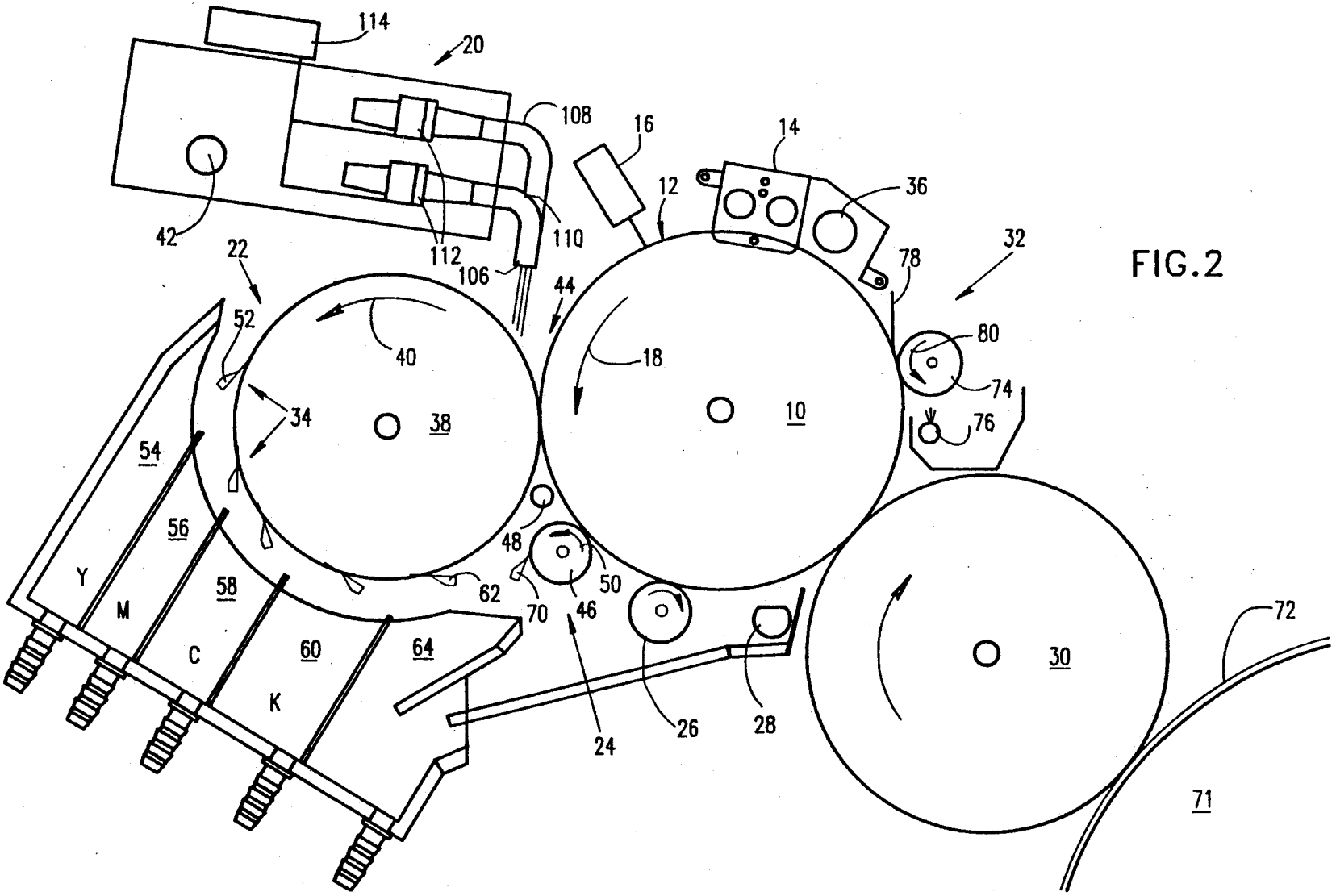
FIG. 2 is a schematic illustration of a portion of the apparatus of FIG. 1.

Reference is now made to FIGS. 1 and 2 which illustrate a multicolor electrostatic imaging system constructed and operative in accordance with a preferred embodiment of the present invention. As seen in FIGS. 1 and 2 there is provided an image bearing surface 12 typically embodied in a rotating photoconductive drum 10. Drum 10 is driven in any appropriate manner (not shown) in the direction of arrow 18 past charging apparatus 14, preferably a corotron, adapted to charge the surface of the photoconductive drum 10. The image to be reproduced is focused by imaging apparatus 16 upon the charged surface 12 at least partially discharging the photoconductor in the areas struck by light and forming the electrostatic latent image. Thus the latent image normally includes image areas at a first electrical potential and background areas at another electrical potential.

Photoconductive Drum 10 and photoconductor charging apparatus 14 may be any suitable drum and charging apparatus such as are well known in the art.

Imaging apparatus 16 may be a modulated laser beam scanning apparatus, an optical focusing device for imaging a copy on a drum or other imaging apparatus such as is known in the art. Alternatively, drum 10 may have a fixed electrostatic latent image thereon or may be a dielectric material onto which charge is deposited in an image form.

Also associated with photoconductive drum 10 are a multicolor liquid developer spray assembly 20, a developing assembly 22, color specific cleaning blade assemblies 34, a background cleaning station 24, an electrified squeegee 26, a background discharge device 28, an intermediate transfer member 30, cleaning apparatus 32, and a neutralizing lamp assembly 36.

Developing assembly 22 preferably includes a development roller 38. Development roller 38 is preferably spaced from photoconductive drum 10 thereby forming a gap between development roller 38 and drum 10 which is typically 40 to 150 $\mu$m and is charged to an electrical potential intermediate that of the image and background areas of photoconductive drum 10. Development roller 38 is thus operative when maintained at a proper voltage to apply an electric field to aid development of the latent electrostatic image.

Development roller 38 typically rotates in the same sense as drum 10 as indicated by arrow 40. This rotation provides for the surface of drum 10 and development roller 38 to have opposite velocities in their region of propinquity.

Multicolor liquid developer spray assembly 20, which is described in more detail herein below, is preferably mounted on axis 42 to allow assembly 20 to be pivoted in such a manner that a spray of liquid toner containing electrically charged pigmented toner particles can be directed either onto a portion of the development roller 38, a portion of the photoconductive drum 10 or directly into a development region 44 between drum 10 and development roller 38.

Color specific cleaning blade assemblies 34 are operatively associated with developer roller 38 for separate removal of residual amounts of each colored toner remaining thereon after development. Each one of blade assemblies 34 is selectably brought into operative association with developer roller 38 only when toner of a color corresponding thereto is supplied to development region 44 by spray assembly 20. The construction and operation of cleaning blade assembly 34 is described in PCT International Publication number WO 90/14619, the disclosure of which is incorporated herein by reference.

Each of cleaning blade assemblies 34 includes a toner directing member 52 which serves to direct the toner removed by the cleaning blade assemblies 34 from the developer roller 38 to separate collection containers 54, 56, 58, and 60 and thus to prevent contamination of the various developers by mixing of the colors. The toner collected by collection containers 54, 56, 58 and 60 is recycled to a corresponding toner reservoir (55, 57, 59 and 61). A final toner directing member 62 always engages the developer roller 38 and the toner collected thereby is supplied into collection container 64 and thereafter to reservoir 65 via separator 66 which is operative to separate relatively clean carrier liquid from the various colored toner particles. The separator 66 may be typically of the type described in PCT International Publication Number WO90/10896 the disclosure of which is incorporated herein by reference.

Figure 4:
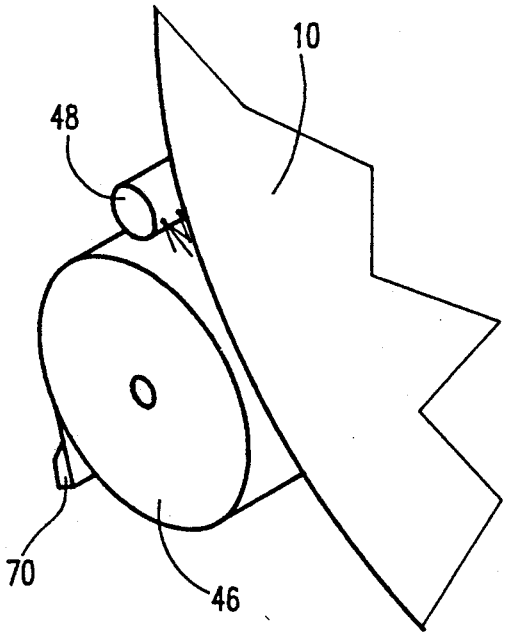
FIG. 4 is a side perspective illustration of the background cleaning station.

Background cleaning station 24, which is more clearly shown in FIG. 4, includes a reverse roller 46 and a fluid spray apparatus 48. Reverse roller 46 which rotates in a direction indicated by arrow 50 is electrically biased to a potential intermediate that of the image and background areas of photoconductive drum 10. Reverse roller 46 is preferably spaced apart from photoconductive drum 10 thereby forming a gap between reverse roller 46 and drum 10 which is typically 40 to 150 μm.

Fluid spray apparatus 48 receives liquid toner from reservoir 65 via conduit 88 and operates to provide a supply of clear non-polar liquid to the gap between photoconductive drum 10 and reverse roller 46. The liquid supplied by fluid spray apparatus 48 replaces the liquid removed from drum 10 by development assembly 22 thus allowing the reverse roller 46 to remove charged pigmented toner particles by electrophoresis from the background areas of the latent image. Excess fluid is removed from reverse roller 46 by a liquid directing member 70 which continuously engages reverse roller 46 to collect excess liquid containing toner particles of various colors which is in turn supplied to reservoir 65 via a collection container 64 and separator 66.

An electrically biased squeegee roller 26 such as that described in U.S. Pat. No. 4,286,039, the disclosure of which is herein incorporated by reference, is preferably urged against the surface of drum 10 and is operative to remove substantially all of the liquid carrier from the background regions and to compact the image and remove liquid carrier therefrom in the image regions. The squeegee roller 26 is preferably formed of resilient slightly conductive polymeric material, and is charged to a potential of several hundred to a few thousand volts with the same polarity as the polarity of the charge on the toner particles.

Discharge device 28 is operative to flood the drum 10 with light which is operative to discharge the voltage remaining on drum 10 mainly to reduce electrical breakdown and improve transfer of the image to intermediate transfer member 30.

Intermediate transfer member 30 may be any suitable intermediate transfer member such as those described in PCT International Publication WO 90/08984 the disclosure of which is incorporated herein by reference, and is maintained at a suitable voltage and temperature for electrostatic transfer of the image thereto from the image bearing surface and therefrom to a final substrate 72. Intermediate transfer member 30 is preferably associated with a pressure roller 71 for transfer of the image onto a final substrate 72, such as paper, preferably by heat and pressure.

Cleaning apparatus 32 is operative to scrub clean the surface of photoconductive drum 10 and includes a cleaning roller 74, a sprayer 76 to spray a non polar cleaning liquid to assist in the scrubbing process and a wiper blade 78 to complete the cleaning of the photoconductive surface. Cleaning roller 74 which may be formed of any synthetic resin known in the art for this purpose is driven in a direction of rotation opposite to that of drum 10 as indicated by arrow 80. Any residual charge left on the surface of photoconductive drum 10 is removed by flooding the photoconductive surface with light from neutralizing lamp assembly 36.

In accordance with a preferred embodiment of the invention, after developing each image in a given color, the single color image is transferred to intermediate transfer member 30. Subsequent images in different colors are sequentially transferred in alignment with the previous image onto intermediate transfer member 30. When all of the desired images have been transferred thereto, the complete multi-color image is transferred from transfer member 30 to substrate 72. Impression roller 71 only produces operative engagement between intermediate transfer member 30 and substrate 72 when transfer of the composite image to substrate 72 takes place. Alternatively, each single color image is transferred to the substrate after its formation. In this case the substrate is fed through the machine once for each color or is held on a platen and contacted with intermediate transfer member 30 during image transfer. Alternatively, the intermediate transfer member is omitted and the developed single color images are transferred sequentially directly from drum 10 to substrate 72.

Figure 3:
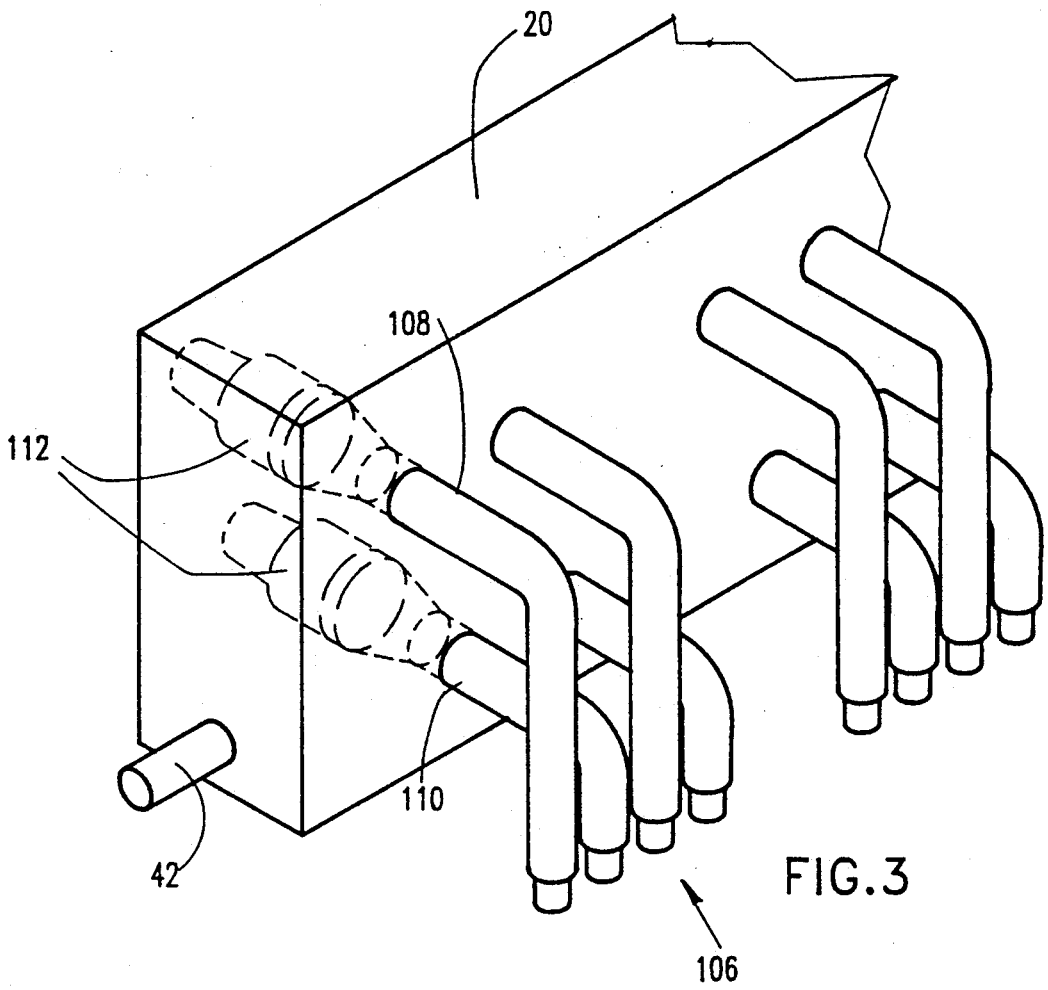
FIG. 3 is a front perspective illustration of a pivotable multicolor liquid developer spray assembly.

Reference is now made additionally to FIGS. 1, 2 and 3 in which it is seen that the multicolor toner spray assembly 20 receives separate supplies of colored toner typically from four different reservoirs 55, 57, 59 and 61. FIG. 1 shows four different colored toner reservoirs 55, 57, 59 and 61 typically containing the colors Yellow, Magenta, Cyan and optionally Black respectively. Pumps 90, 92, 94 and 96 may be provided along respective supply conduits 98, 100, 102 and 104 for providing a desired amount of pressure to feed the colored toner to multicolor spray assembly 20. Alternatively, multicolor toner spray assembly 20, which is preferably a three level spray assembly, receives supplies of colored toner from six different reservoirs (not shown) which allows for custom colored tones in addition to the standard process colors.

Associated with each of reservoirs 55, 57, 59, and 61 are typically provided containers of charge director and toner concentrate, indicated respectively by reference numerals 82 and 84 as well as a supply of carrier liquid, indicated generally by reference numeral 86.

Each of the reservoirs 55, 57, 59 and 61 also typically receives an input of recycled toner of a corresponding color from developer assembly 22 as described above.

Reference is now made to FIGS. 2 and 3 which illustrate one embodiment of a multicolor toner spray assembly 20. In the embodiment of FIG. 3 it is seen that there is provided a linear array of spray outlets 106, each of which communicates with one of the four conduits 98, 100, 102, and 104. The outlets 106 leave the conduits 98, 100, 102 and 104 at one of two levels 108 and 110 to permit the minimization of separation between the outlets 106.

The spray outlets 106 are preferably interdigitated such that when four toner colors are used preferably every fourth outlet 106 sprays the same color toner and that every group of four adjacent outlets includes outlets 106 which spray four different colors. When six toner colors are used preferably every sixth outlet 106 spays the same color toner and that every group of six adjacent outlets 106 includes outlets 106 which spray six different colors.

Colored toner is sprayed under pressure from each of the outlets 106 into the development region 44. The spacing of the spray outlets 106 and their periodicity is selected to enable the toner for each individual given color to substantially uniformly fill region 44. This can result in a uniform array or preferably the colors are grouped in clusters each of which contains one outlet for each color. Typically these clusters have a center to center spacing of between 40–60 mm.

In a particular embodiment of FIG. 3 the center to center spacing between two adjacent outlets 106 in the linear array is 6.5 mm, and the spray outlets have an inner diameter of 4 mm. It may be appreciated, however, that the distance between outlets 106 may vary widely in other embodiments of the invention as long as the distribution of liquid toner is sufficient to allow for uniform development.

The flow of toner to each of the outlets 106 from conduits 98, 100, 102 and 104 is regulated by valves 112 which are controlled by controller 114. The valves 112 may be electrically controlled valves which are opened or closed by controller 114, as for example type 200 valves available from Burkert, Ingelfingen, Germany. In an alternate preferred embodiment of the invention, valves 112 are check (one-way) valves which only allow for flow toward outlets 106 and controller 114 is omitted. In a preferred embodiment of the invention a spring loaded non-return valve is used. In this preferred embodiment overall toner flow is controlled by a single valve 120 for each of the colors. Valves 120 include a filter preferably a polyester mesh filter having 200–300 micron openings. The purpose of this filter is to remove paper fibers, fused toner, etc. which may clog valves 112. In either event, the provision of valves 112 prevents siphoning which would cause dripping from the outlet after the main flow of toner is shut off. Where the toner supply to be shut off only by shutting the supply to the conduits 98, 100, 102 and 104 dripping would occur which would result in the mixing of colors, or in a long "dead" time between colors. This individual shut off of each spray outlet or the provision of check valves in each outlet allows for almost instantaneous change of developer color at the development region 44.

In any event, the amount of toner that is applied to drum 10 or development roller 38 in accordance with the present invention is sufficient to provide a layer of toner of thickness that at least substantially fills the gap between drum 10 and development roller 38.

Reference is again made to FIGS. 1 and 2 which illustrate a development assembly 22 and a reverse roller 46 constructed and operative in accordance with a preferred embodiment of the invention. The development assembly 22 includes development roller 38 which operatively engages photoconductor drum 10 in spaced relationship therewith and, due to its rotation in the same sense as photoconductor drum 10, acts inter alia as a metering device. This metering effect ensures that very little liquid carries through the nip of the development region.

As noted above, it is known in the art to employ an electrically biased development roller in a liquid toner electrophotographic imaging system. The roller is charged to a suitable voltage somewhere between the voltages of image and background areas of the photoconductive drum. At such a suitable voltage the roller produces good image development without toner deposition on the background.

It has been found by the inventors that when the speed of the drum and the development roller are increased to increase the speed of operation of the system there is an unacceptable level of deposition of toner on the background surface at the boundary area between the image and background surfaces downstream of the image areas. This unwanted deposition is hereinafter referred to as "smearing".

This phenomenon appears to be the result of the dynamics of toner particle migration in the development zone 44 where an electrostatic field is set up between electrically charged development roller 38 and electrically charged image areas and background areas of drum 10. Increasing the voltage difference between background areas of drum 10 and development roller 38 decreases background smearing but, since it also decreases the voltage difference between the image areas of drum 10 and development roller 38 it also degrades the image. This image degradation appears to be caused by inhibiting migration of toner particles to the image areas of drum 10 resulting in a reduction in image optical density.

When development roller 38, maintained at a voltage which gives good developed image density, but which by itself would result in background smearing, is used in conjugation with background cleaning station 24 improved images are obtained.

Background cleaning station 24 comprises a reverse roller 46 typically maintained at a voltage difference from the background area of drum 10 which is greater than that of development roller 38. A fluid spray apparatus 48 sprays liquid toner to the region between reverse roller 46 and drum 10 to fill the gap between roller 46 and drum 10 so as to permit electrophoretic migration of toner particles from the background areas of drum 10 to reverse roller 46.

Figure 5:
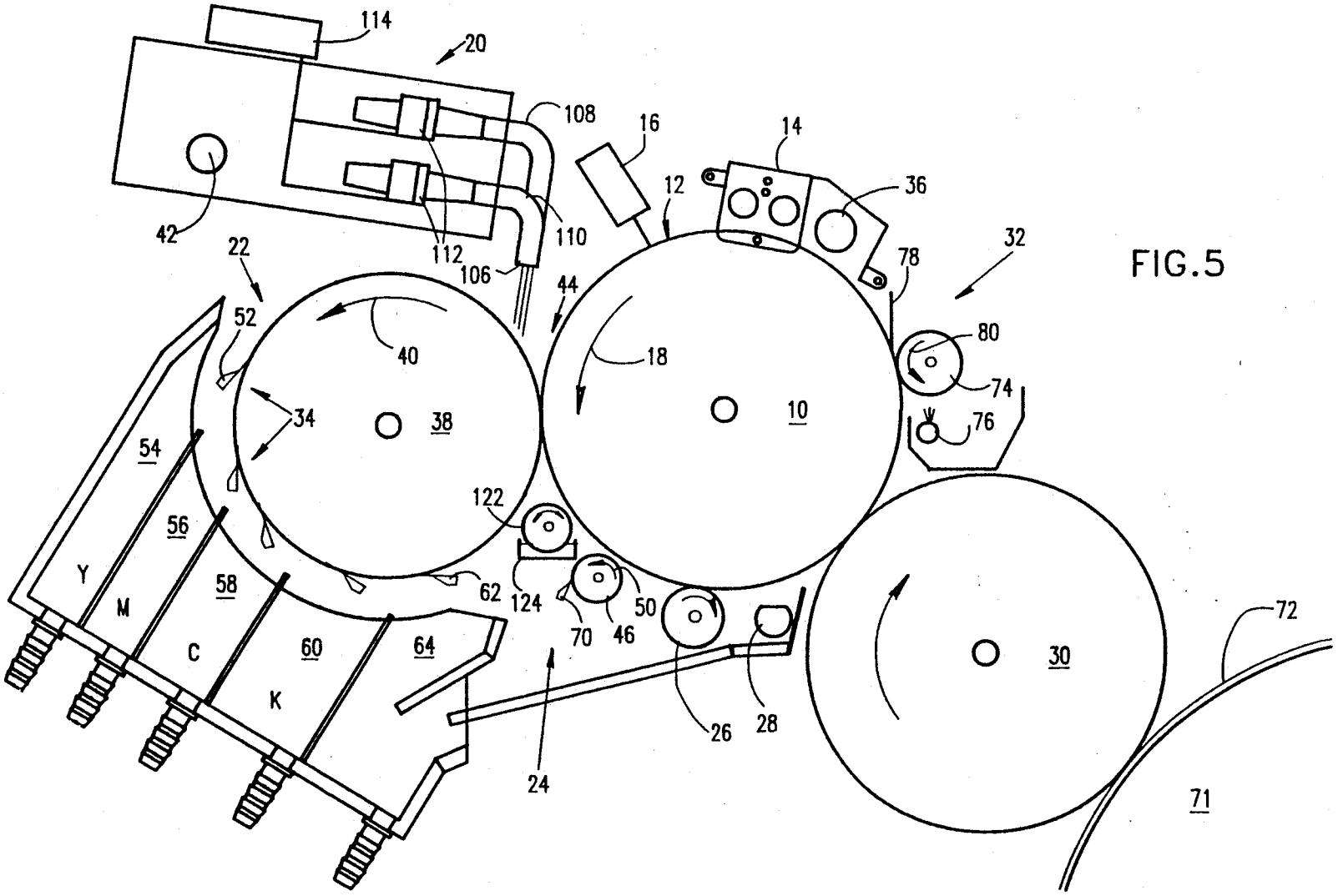
FIG. 5 is a schematic illustration of a portion of an alternative preferred embodiment of the invention.

Other means can be used for wetting this gap. For example as shown in FIG. 5, a roller 122 is partially placed in a container 124 containing clear liquid, and is rotated to pump clear liquid to the surface of drum 10. Roller 122 is either a forward or a reverse roller.

Figure 6:
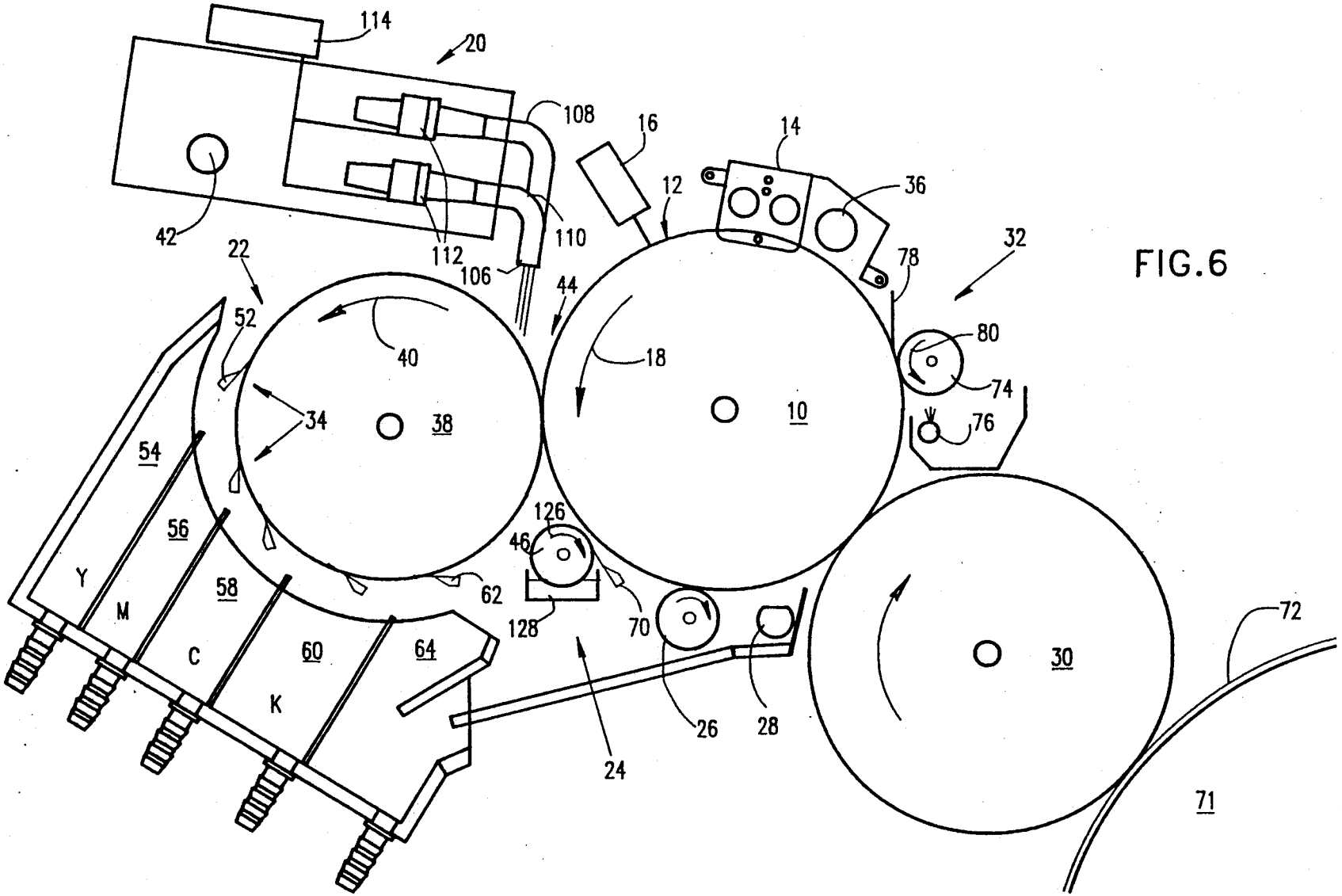
FIG. 6 is a schematic illustration of a portion of another alternative preferred embodiment of the invention.

Alternatively, as shown in FIG. 6, roller 46 is a forward roller rotating in the direction of arrow 126. Roller 46 is partially placed in a container 128, containing clear liquid and pumps same to the gap between roller 46 and drum 10. Squeegee roller 26 is then operative to remove liquid remaining on the drum therefrom.

Roller 46 is maintained at a voltage intermediate the image and background voltages so that toner particles from the image areas of drum 10 are not removed, thereby permitting operation of a color electrostatic imaging system at rates which exceed those which could previously be attained.

In a typical system operating at a process speed of 60 cm/sec, the image areas of drum 10 are at a voltage of −60 volts, the background areas are at a voltage of −1000 volts. Development roller 38 is set to a voltage of −500 volts, is spaced from drum 10 by 60 μm and has a surface speed of 100 cm/sec. Roller 46 is a reverse roller at a voltage of −150 volts, is spaced from drum 10 by 50 μm and has a surface speed of 95 cm/sec. Negatively charged toner is used in a write-black mode. These voltages and spacings are not fixed values, but depend on process speed, toner charge, mobility and viscosity, photoconductor type and image light discharge power, the spacing of the rollers from each other, and on other factors.

The above mentioned voltages are suitable for the use of negatively charged toner and an organic photoconductor drum. If it is desired to use a positively charged toner or another type of photoconductor material, correspondingly different voltages will be appropriate.

This embodiment utilizes multicolor spray assembly 20 in which the spray is directed to the development region 44 between the drum 10 and development roller 38. Alternatively the spray can be directed toward the surface of photoconductor drum 10 or either generally onto development roller 38 or more preferably toward upper surface of development roller 38. It should be noted that the rotation of development roller 38 is such as to carry the developer liquid away from a development region 44. Nevertheless the multicolor spray assembly produces a sufficient amount of force to assure that there is a supply of liquid developer at the development region.

A preferred type of toner for use with the present invention is that described in Example 1 of U.S. Pat. No. 4,794,651, the disclosure of which is incorporated herein by reference. Other toners may alternatively be employed. For colored liquid developers, carbon black is replaced by color pigments as is well known in the art.

While the invention has been described utilizing a roller developer and a drum photoconductor, it is understood that the invention can be practiced utilizing a belt developer and/or a belt photoconductor.

It will be appreciated by persons skilled in the art that the present invention is not limited by what has been particularly shown and described hereinabove. Rather the scope of the present invention is defined only by the claims which follow:

We claim:

1. Imaging apparatus comprising:

an electrostatic imaging surface;

latent image forming means for forming an electrostatic latent image on said electrostatic imaging surface; and development means for developing said electrostatic latent image including:

supply means for supplying a particular liquid toner to the image forming surface, said supply means comprising a plurality of independently controllable outlets for supplying said particular liquid toner; and a development surface for developing said electrostatic latent image using said particular liquid toner.

2. Apparatus according to claim 1 wherein said plurality of outlets comprise a plurality of spray outlets.

3. Apparatus according to claim 1 wherein said supply means is a multi-color supply means for supplying a plurality of liquid toners having a plurality of colors and comprising a multiplicity of outlets including a plurality of individually controllable outlets each said plurality of outlets supplying liquid toner of a particular color.

4. Apparatus according to claim 2 wherein said plurality of outlets comprise a plurality of spray outlets.

5. Imaging apparatus comprising:

an electrostatic imaging surface;

latent image forming means for forming an electrostatic latent image on said electrostatic imaging surface; and development means for developing said electrostatic latent image including supply means for supplying a liquid toner to the image forming surface, said supply means comprising:

a multiplicity of outlets for supplying said liquid toner;

at least one manifold for supplying liquid toner to said multiplicity of outlets including means for effecting and halting the flow of the liquid toner to the manifold; and means for preventing further discharge of liquid toner from the outlets after the flow is halted comprising means for preventing flow from said outlets to said manifold.

6. Apparatus according to claim 5 wherein said supply means is a multi-color supply means and said multiplicity of outlets includes a plurality of individually controllable outlets, for supplying liquid toner of each of a plurality of colors and said at least one manifold includes separate manifolds for each said color.

7. Apparatus according to claim 6 wherein said multiplicity of outlets comprise a multiplicity of spray outlets.

8. Apparatus according to claim 7 wherein said multiplicity of spray outlets form a single row.

9. A system according to claim 11 wherein said single row of spray outlets comprises a linear array of interdigitated spray outlets for liquid toner of different colors.

10. Apparatus according to claim 5 wherein said multiplicity of outlets comprise a multiplicity of spray outlets.

11. Apparatus according to claim 7 wherein said multiplicity of spray outlets form a single row.

12. Apparatus according to claim 5 wherein said means for preventing includes at least one one-way valve which allows for toner flow only from said manifold to said outlets.

13. Apparatus according to claim 12 and also including a filter operative to remove particles from said toner which clog said one-way valves.

* * * * *

UNITED STATES PATENT AND TRADEMARK OFFICE

CERTIFICATE OF CORRECTION

PATENT NO. : 5,117,263

DATED : May 26, 1992

INVENTOR(S) : Y. ADAM et al.

It is certified that error appears in the above-indentified patent and that said Letters Patent is hereby corrected as shown below:

At column 1, line 33, change "a" to —an—.

At column 8, line 23, change (claim 4, line 1), change "2" to —3—.

At column 8, line 53 (claim 9, line 1), change "11" to —8—.

At column 8, line 59 (claim 11, line 1), change "7" to —10—.

Signed and Sealed this

Twenty-seventh Day of February, 1996

*Attest:*

Bruce Lehman

BRUCE LEHMAN

*Attesting Officer*

*Commissioner of Patents and Trademarks*